US012208948B2

(12) United States Patent
Owen

(10) Patent No.: US 12,208,948 B2
(45) Date of Patent: Jan. 28, 2025

(54) CHILD-RESISTANT CONTAINER ASSEMBLY

(71) Applicant: Closure Systems International Inc., Indianapolis, IN (US)

(72) Inventor: Robert H. Owen, Crawfordsville, IN (US)

(73) Assignee: Closure Systems International Inc., Indianapolis, IN (US)

( * ) Notice: Subject to any disclaimer, the term of this patent is extended or adjusted under 35 U.S.C. 154(b) by 0 days.

(21) Appl. No.: 18/162,998

(22) Filed: Feb. 1, 2023

(65) Prior Publication Data

US 2024/0253873 A1 Aug. 1, 2024

(51) Int. Cl.
*B65D 50/04* (2006.01)
*B65D 50/06* (2006.01)

(52) U.S. Cl.
CPC ..... *B65D 50/06* (2013.01); *B65D 2215/04* (2013.01)

(58) Field of Classification Search
CPC .... B65D 43/12; B65D 43/20; B65D 43/0222; B65D 41/026; B65D 50/046
USPC .... 220/345.2, 345.3, 350, 351, 345.4, 345.6
See application file for complete search history.

(56) References Cited

U.S. PATENT DOCUMENTS 2,492,846 A 12/1949 Coyle
3,126,444 A * 3/1964 Taylor ..... H02G 3/0418 220/345.2
3,240,373 A 3/1966 Dulle
3,942,630 A * 3/1976 Phillips ..... B65D 43/12 220/345.3
5,082,137 A 1/1992 Weinstein
5,253,774 A * 10/1993 Honig ..... G01N 35/1002 215/322
D398,241 S 9/1998 Krebs
D414,425 S 9/1999 Crawford
6,029,835 A 2/2000 DeJonge
(Continued)

FOREIGN PATENT DOCUMENTS

CN 106005726 A 10/2016
DE 3324151 A1 * 1/1985
(Continued)

OTHER PUBLICATIONS

U.S. Appl. No. 17/869,154, filed Jul. 20, 2022, Alex E. Kittleson, Child-Resistant Closure and Package.
(Continued)

*Primary Examiner* — Allan D Stevens
(74) *Attorney, Agent, or Firm* — NIXON PEABODY LLP

(57) ABSTRACT

A container assembly includes a container and a lid. The container has a sidewall, a bottom and a flange. The sidewall includes a child-resistant release tab that moves towards the sidewall. The release tab forms an opening therein. The flange includes ramp projections. The lid includes a top portion and opposing retention sidewalls. The retention sidewalls include a stop projection. An interior surface of the polymeric slidable lid includes a sealing liner. The stop projection and the release tab assist in preventing or inhibiting movement of the container assembly from a closed to an open position. After the release tab is moved towards the sidewall, the lid can slide from a closed to an open position. The lid contacts the ramp projections resulting in further movement of the lid into a different axial plane spaced above the flange.

19 Claims, 16 Drawing Sheets

(56) References Cited

U.S. PATENT DOCUMENTS

| | | | | |
|---|---|---|---|---|
| D477,222 | S | 7/2003 | Pitassi | |
| D506,388 | S | 6/2005 | Pitassi | |
| D534,067 | S | 12/2006 | Tanner | |
| D539,642 | S | 4/2007 | Tanner | |
| 7,275,653 | B2 | 10/2007 | Tedford, Jr. | |
| 7,594,588 | B2 | 9/2009 | Auer | |
| 7,861,873 | B1 * | 1/2011 | Bragg | B65D 50/046 220/254.5 |
| D649,869 | S | 12/2011 | Gibson | |
| 8,292,101 | B1 * | 10/2012 | Bragg | B65D 47/0838 220/254.5 |
| D683,626 | S | 6/2013 | Beck | |
| D691,045 | S | 10/2013 | Toh | |
| D694,624 | S | 12/2013 | Crawford | |
| 9,365,333 | B2 | 6/2016 | Batzel | |
| D804,903 | S | 12/2017 | Mason | |
| D804,904 | S | 12/2017 | Noveletsky | |
| 9,919,837 | B2 | 3/2018 | Batzel | |
| D846,984 | S | 4/2019 | Bos | |
| D878,920 | S | 3/2020 | Batzel | |
| D909,869 | S | 2/2021 | Batzel | |
| 2006/0138145 | A1 | 6/2006 | Toth | |
| 2007/0164032 | A1 * | 7/2007 | Cronin | B65D 43/12 220/345.1 |
| 2008/0128420 | A1 * | 6/2008 | Wang | B65D 51/242 220/345.1 |
| 2009/0283437 | A1 * | 11/2009 | Angelucci | A61J 1/03 206/532 |
| 2011/0204074 | A1 * | 8/2011 | Gelardi | B65D 85/10 277/312 |
| 2013/0256163 | A1 * | 10/2013 | Cottle | A24F 15/00 206/265 |
| 2013/0320017 | A1 * | 12/2013 | Kientzle | B65D 47/286 220/345.3 |
| 2015/0090686 | A1 | 4/2015 | Batzel | |
| 2016/0229598 | A1 * | 8/2016 | Coffey | B65D 17/30 |
| 2016/0297580 | A1 | 10/2016 | Batzel | |
| 2017/0144807 | A1 * | 5/2017 | Rud | B65D 75/366 |
| 2018/0222642 | A1 * | 8/2018 | Rud | B65D 43/20 |
| 2020/0270033 | A1 * | 8/2020 | Sanguinet | B65D 17/4012 |
| 2021/0086957 | A1 * | 3/2021 | Kade | B65D 65/466 |
| 2021/0253310 | A1 * | 8/2021 | Wong | B65D 43/164 |
| 2021/0300640 | A1 * | 9/2021 | Ludewig | B65D 51/24 |
| 2023/0028311 | A1 * | 1/2023 | Robison | B65D 50/046 |
| 2023/0063077 | A1 * | 3/2023 | Gift | A61J 1/1437 |

FOREIGN PATENT DOCUMENTS

| | | | | |
|---|---|---|---|---|
| DE | 4314920 | A1 | 11/1994 | |
| KR | 20140134500 | A * | 11/2014 | |
| WO | 0115998 | A1 | 3/2001 | |
| WO | WO-0155001 | A1 * | 8/2001 | B65D 43/20 |

OTHER PUBLICATIONS

U.S. Appl. No. 17/741,118, filed May 10, 2022, Robert H. Owen, Child-Resistant Closure and Package.

International Search Report and Written Opinion in International Patent Application No. PCT/US2024/012743 mailed May 13, 2024, 12 pp.

* cited by examiner

CHILD-RESISTANT CONTAINER ASSEMBLY

FIELD OF THE INVENTION

The present invention relates generally to a container assembly including a closure and a lid. More specifically, the present invention relates to a child-resistant container assembly with a polymeric movable lid.

BACKGROUND OF THE INVENTION

Polymeric lid or closures have been used in many applications over the years in conjunction with containers. Some containers contain product or contents that are not intended for certain individuals, such as children. These contents may include products such as over the counter (OTC) medication, vitamins, prescriptions, etc. These containers are desirably child-resistant such that children are prevented or inhibited from gaining access to the products therein. These containers, however, may be difficult for other individuals to open and access the products contained therein. These other individuals may be those with reduced gripping strength, limited dexterity of their upper limbs (e.g., arms or hands), or other disabilities of their upper limbs that make such containers difficult to open.

Some technologies include a multi-piece system that includes an outer shell, an inner shell, and a compressible liner. The inner and outer shells float independently in a rotational orientation and the outer shell needs to be depressed and rotated to engage the inner shell to disengage the closure from the container. This, however, requires a predetermined amount of force and dexterity to hold the container and closure, and then engage to open. This, undesirably, creates an unfavorable challenge for users with upper extremity related disabilities. Additionally, this technology tends to be relatively costly in relation to other closure systems.

It would be desirable to provide a child-resistant container assembly that overcomes these disadvantages of existing containers, while still performing desirable properties including securely positioning the lid on the container.

SUMMARY

According to one aspect of the present disclosure, a container assembly comprises a container and a polymeric slidable lid. The container has at least one sidewall, a bottom and a flange. The at least one sidewall includes a child-resistant release tab extending outwardly therefrom and being configured for movement towards the at least one sidewall. The child-resistant release tab forms a first opening or slot therein. The flange and the at least one sidewall assist in forming a second opening defining an interior of the container. The flange includes an exterior surface and an interior surface. The flange includes a plurality of ramp projections extending upwardly from the exterior surface thereof. The polymeric slidable lid is configured for fitment to the container for closing the second opening. The polymeric slidable lid includes an exterior surface and an interior surface. The polymeric slidable lid includes a polymeric top portion and two opposing retention sidewalls. The polymeric top portion bridges and encompasses the two opposing retention sidewalls. The at least one of the two opposing retention sidewalls includes a sidewall portion and a stop projection extending inwardly from the sidewall portion. The interior surface of the polymeric slidable lid includes a sealing liner. The stop projection and the child-resistant release tab assist in preventing or inhibiting movement of the container assembly from a closed position to an open position. After the child-resistant release tab is moved towards the at least one sidewall, the polymeric slidable lid is configured to slide from a closed position to an open position. The polymeric slidable lid is configured to contact the plurality of ramp projections resulting in further movement of the polymeric slidable lid into a different axial plane spaced above the flange of the container.

According to a further configuration of the above implementation, the flange is an outwardly extending flange. The flange is non-continuous in one embodiment.

In a further aspect of the above implementation, the flange forms a plurality of nubs on a top surface thereof. The plurality of nubs assists in stabilizing the polymeric slidable lid in the open position. The plurality of nubs may be located in the corners and in the middle portion of the top surface of the flange.

In a further aspect of the above implementation, each of the plurality of ramp projections is an elongated pyramid with a truncated, flat top portion or is of a trapezoidal shape.

In yet a further aspect of the above implementation, two of the plurality of ramp projections are directly adjacent to the child-resistant release tab.

In yet a further aspect of the above implementation, the at least one sidewall is a plurality of sidewalls. The plurality of sidewalls is of a rectangular shape.

According to a further configuration of the above implementation, the child-resistant release tab is integrally formed with the at least one sidewall.

In a further aspect of the above implementation, the interior surface of the flange includes a plurality of inverted projections. Each of the opposing retention sidewalls includes a plurality of undercut projections that assist in preventing or inhibiting the polymeric slidable lid from being removed axially from the container. The plurality of inverted projections and the plurality of undercut projections assist in providing a compressed seal between the sealing liner and the container.

In a further aspect of the above implementation, the polymeric top portion has an exterior surface and an interior surface. The exterior surface of the polymeric top portion includes a plurality of ridges to assist a user in sliding the polymeric slidable lid to expose the second opening of the container.

In yet a further aspect of the above implementation, each of the two opposing retention sidewalls includes a stop projection extending inwardly from the sidewall portion.

In yet a further aspect of the above implementation, each of the two opposing retention sidewalls includes a plurality of undercut projections that assist in preventing or inhibiting the polymeric slidable lid from being removed axially from the container.

In yet a further aspect of the above implementation, the exterior surface of the polymeric slidable lid includes a mechanical stop to assist in preventing or inhibiting the polymeric slidable lid from being removed from the container during movement of the polymeric slidable lid.

According to another aspect of the present disclosure, a process for opening a container assembly includes providing a container having at least one sidewall, a bottom and a flange. The at least one sidewall includes a child-resistant release tab extending outwardly therefrom. The child-resistant release tab forms a first opening or slot therein. The flange and the at least one sidewall assist in forming a second opening defining an interior of the container. The flange includes an exterior surface and an interior surface.

The flange includes a plurality of ramp projections extending upwardly from the exterior surface thereof. A polymeric slidable lid is configured for fitment to the container for closing the second opening is provided. The polymeric slidable lid includes an exterior surface and an interior surface. The polymeric slidable lid includes a polymeric top portion and two opposing retention sidewalls. The polymeric top portion bridges and encompasses the two opposing retention sidewalls. At least one of the two opposing retention sidewalls includes a sidewall portion and a stop projection extending inwardly from the sidewall portion. The interior surface of the polymeric slidable lid includes a sealing liner. The child-resistant release tab is moved towards the at least one sidewall and, thereafter, the polymeric slidable lid is slid in a direction transverse to the movement of the child-resistant release tab so as to move the container assembly from a closed position to an open position.

According to a configuration of the above implementation, the movement of polymeric slidable lid results in the polymeric slidable lid being spaced from the container in a different axial plane. The different axial plane is parallel to a top surface of the container in one embodiment.

According to a configuration of the above implementation, the flange forms a plurality of nubs on a top surface thereof. The plurality of nubs assists in stabilizing the polymeric slidable lid in the open position.

According to another configuration of the above implementation, each of the two opposing retention sidewalls includes a plurality of undercut projections that assist in preventing or inhibiting the polymeric slidable lid from being removed axially from the container.

According to a further configuration of the above implementation, the exterior surface of the polymeric slidable lid includes a mechanical stop to assist in preventing or inhibiting the polymeric slidable lid from being removed from the container during movement of the polymeric slidable lid.

The above summary is not intended to represent each embodiment or every aspect of the present invention. Additional features and benefits of the present invention are apparent from the detailed description and figures set forth below.

BRIEF DESCRIPTION OF THE DRAWINGS

Other advantages of the invention will become apparent upon reading the following detailed description and upon reference to the drawings in which.

Figure 1A:
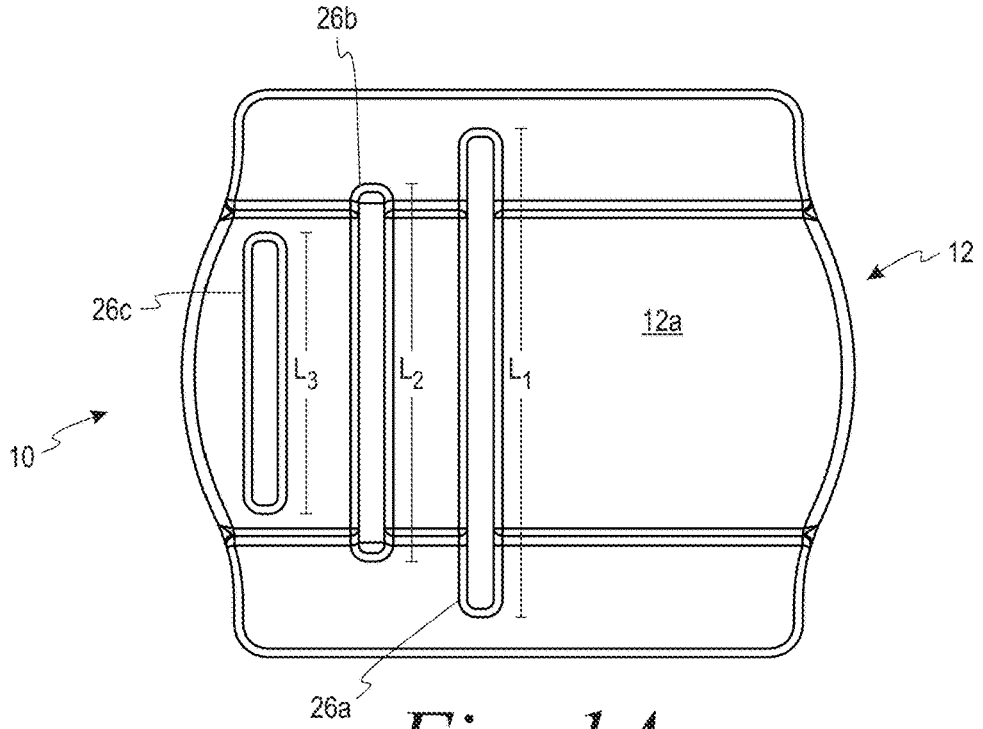
FIG. 1A is a top view of a slidable lid according to one embodiment.

While the invention is susceptible to various modifications and alternative forms, specific embodiments thereof have been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DETAILED DESCRIPTION

Figure 1B:
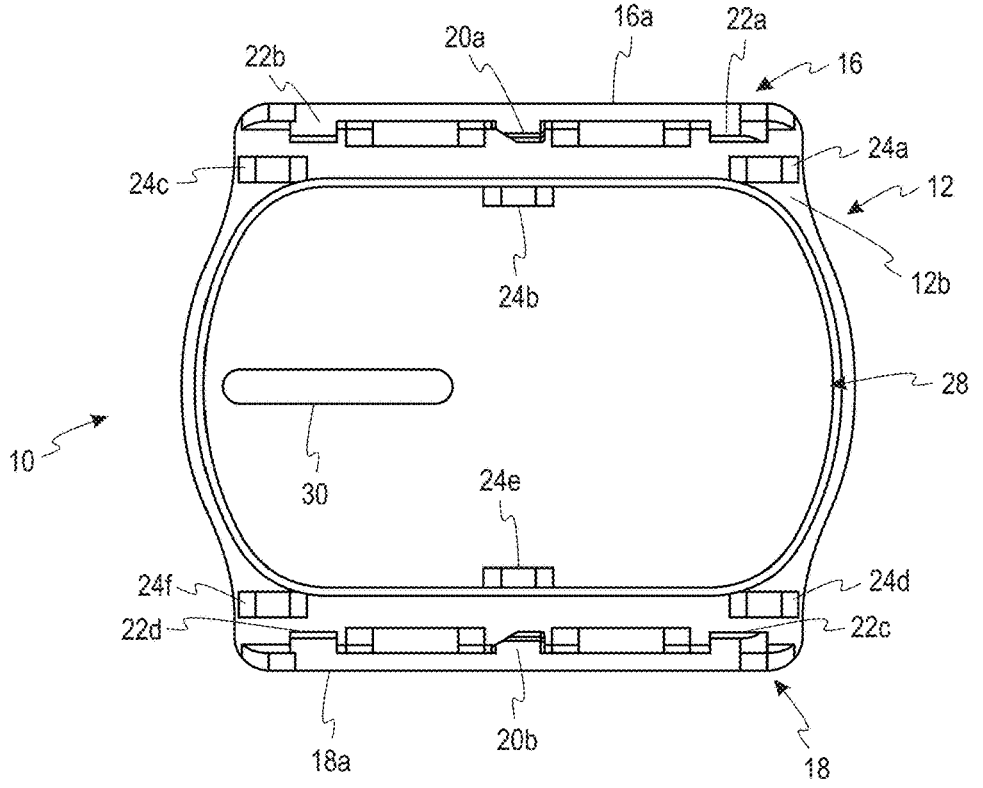
FIG. 1B is a bottom view of the lid of FIG. 1A.
Figure 1C:
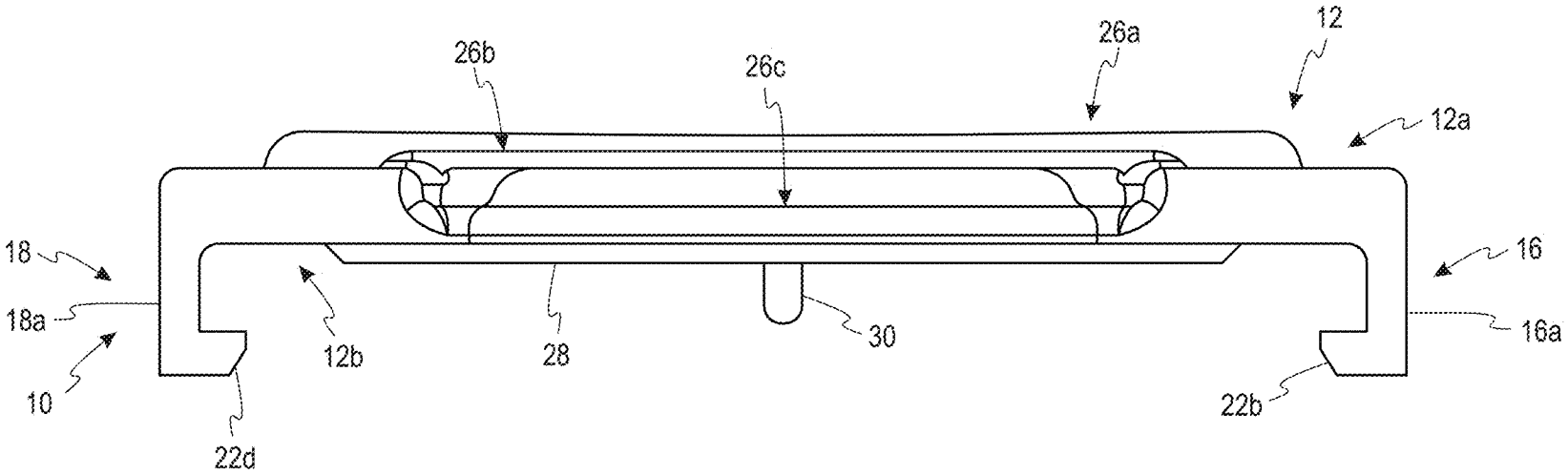
FIG. 1C is a back view of the lid of FIG. 1A.

Referring to FIGS. 1A-1C, a polymeric slidable lid 10 according to one embodiment is shown. The polymeric slidable lid 10 is a one-piece structure in this embodiment. It is contemplated that a polymeric slidable lid may be a two-piece structure in another embodiment. The polymeric slidable lid 10 is configured for fitment to a container for closing an opening of the container. The polymeric slidable lid 10 is configured to be used with a container 100 of FIGS. 2A-2F that forms a container assembly 200 shown in FIGS. 3A-3D.

The container assembly of the present invention is advantageous because it allows users with limited dexterity or reduced gripping strength to open and access the products in the container using much less physical effort. It also is advantageous for users with other disabilities of the upper limbs (e.g., the hand and/or arm) to open and access the products in the container using much less physical effort. The container assembly is also child-resistant in that it takes two separate and distinct actions to gain access into an interior of the container. In one method, the container assembly can be opened to access the product using a single hand.

The polymeric slidable lid 10 of FIGS. 1A-1C includes a polymeric top portion 12 and two opposing retention sidewalls 16, 18. The polymeric top portion 12 bridges and encompasses the two opposing retention sidewalls 16, 18. The two opposing retention sidewalls 16, 18 extend generally or substantially downwardly from the polymeric top portion 12 as shown best in FIG. 1C. The two opposing retention walls 16, 18 are generally or substantially perpendicular to the polymeric top portion 12. The two opposing retention walls 16, 18 assist in properly locating and securing the polymeric slidable lid 10 with respect to the container 100 as will be discussed below.

As shown in FIGS. 1B, 1C, the retention wall 16 includes a sidewall portion 16*a* and a plurality of projections 20*a*,

22*a*, 22*b* that extend inwardly (i.e., towards a center of the polymeric slidable lid 10) from the sidewall portion 16*a*. In this embodiment, the plurality of projections 20*a*, 22*a*, 22*b* encompasses the sidewall portion 16*a*. Similarly, the retention wall 18 includes a sidewall portion 18*a* and a plurality of projections 20*b*, 22*c*, 22*d* that extend inwardly (i.e., towards a center of the polymeric slidable lid 10) from the first sidewall portion 18*a*. In this embodiment, the plurality of projections 20*b*, 22*c*, 22*d* encompasses the sidewall portion 18*a*. As shown in FIG. 1B, the plurality of projections 20*a*, 22*a*, 22*b* is spaced apart from each other on the sidewall portion 16*a*. Similarly, the plurality of projections 20*b*, 22*c*, 22*d* is spaced apart from each other on the sidewall portion 18*a*.

As will be discussed below in detail, one of the two projections 20*a*, 20*b* is a stop projection that assists in preventing or inhibiting movement of the polymeric slidable lid 10 by a user who simply attempts to move the polymeric slidable lid 10 in a linear direction. In this embodiment, projection 20*b* is a stop projection. As will be discussed below, after the child-resistant release tab is moved, the stop projection 20*b* assists in guiding and balancing the polymeric slidable lid 10 during its sliding movement. In other words, the stop projection 20*b*, after the child-resistant release tab is moved, assists in steading the sliding motion of the polymeric slidable lid 10. Which one of the projections is a stop projection depends on which direction the polymeric slidable lid 10 is installed on the container 100. The polymeric slidable lid 10 is bi-directional in that it can be installed onto the container 100 in either direction.

The remaining one of the projections that does not function as a stop projection (projection 20*a* in this embodiment) assists in guiding and balancing the polymeric slidable lid 10 during its sliding movement. In other words, the stop projection assists in steading the sliding motion of the polymeric slidable lid 10.

The projections 22*a*-22*d* are undercut projections that assist in maintaining the polymeric slidable lid 10 with the container 100. As shown in FIG. 1B, the undercut projections 22*a*-22*d* are located in opposing corners on the bottom of the polymeric slidable lid 10. During installation of the polymeric slidable lid 10 onto the container 100, the polymeric slidable lid 10 is snapped or pressed on and over the container 100. The opposing retention sidewalls 16, 18 have some flexibility that allows them to flex outwardly (in the direction away from the center of the polymeric slidable lid) when initially placed onto a flange of the container 100. Once the polymeric slidable lid 10 is flexed outwardly during the placement onto the container 100, the polymeric slidable lid 10 snaps back onto the flange of the container 100 and is held in place by the undercut projections 22*a*-22*d*. Each of the undercut projections 22*a*-22*d* has a chamfered lead on the same to assist in placement onto the flange of the container 100. The undercut projections 22*a*-22*d* assist in preventing or removing the polymeric slidable lid 10 from the container 100 in an axial direction.

The polymeric slidable lid 10 also forms a plurality of recesses 24*a*-24*f* as shown in FIG. 1B. As will be discussed below, the plurality of recesses 24*a*-24*f* is sized to receive one of a plurality of nubs of the container 100 in the closed position.

The polymeric top portion 12 has an exterior surface 12*a* and an interior surface 12*b*. Referring to FIG. 1A, the exterior surface 12*a* of the polymeric top portion 12 forms a plurality of ridges 26*a*-26*c*. The plurality of ridges 26*a*-26*c* is sized and configured to assist a user in sliding the polymeric slidable lid 10 to expose an opening of the container 100. The plurality of ridges 26*a*-26*c* also may assist a user in sliding back the polymeric slidable lid 10 to cover or close the opening of the container 100. The plurality of ridges 26*a*-26*c* is shown as being of varied sizes or, more specifically, different lengths L1-L3, respectively, as shown in FIG. 1A. It is contemplated that the ridges may be of similar sizes (including widths and lengths) or different sizes. The shapes of the ridges formed in the exterior surface of the polymeric top portion may also vary in other embodiments.

Referring to FIGS. 113, 1C, the interior surface 12*b* of the polymeric top portion 12 includes a sealing liner 28 and a mechanical stop 30. The sealing liner 28 extends slightly downwardly in a central portion of the interior surface 12*b*. The sealing liner 28 is sized to snugly fit into an opening of the container 100 to form a seal therewith. Thus, the shape of the sealing liner 28 is the same or similar to the shape of the opening of the container 100 to provide a desired seal.

The sealing liner may be made of the same material as the remainder of the polymeric slidable lid in one embodiment. In another embodiment, the sealing liner may be made of a different material than the remainder of the polymeric slidable lid. If the sealing liner is made of a different material, the polymeric slidable liner is a two-piece structure in which the sealing liner needs to be attached to the remainder of the polymeric slidable lid.

The sealing liner is typically made of a compressible polymeric material and is made of a thickness that provides desired sealing between the polymeric slidable lid 10 and the container 100. In one embodiment, the sealing liner is a polyolefin (e.g., polyethylene or polypropylene), an elastomer (e.g., thermoplastic elastomer), a plastomer, or blends thereof. The thickness of the sealing liner is generally from about 0.020 to about 0.1 inches, more typically, from about 0.030 to about 0.070 inches.

The mechanical stop 30 of FIGS. 1B, 1C prevents or inhibits the polymeric slidable lid 10 from being removed from the container 100 via a generally linear sliding motion. Specifically, the mechanical stop 30 contacts a portion of the container 100 forming the opening to prevent or inhibit further linear movement in that direction. As shown best in FIG. 1C, the mechanical stop 30 extends further downwardly (farther from the exterior surface 12*a* of the polymeric top portion 12) than the sealing liner 28. The mechanical stop 30 is shown as exactly one structure in this embodiment. It is contemplated, however, that there may be more than one mechanical stop formed from an interior surface of the polymeric slidable lid. The location and sizing of the mechanical stop will determine the size of the opening formed between the polymeric slidable lid 10 and the container 100. It is contemplated that the mechanical stop may be of other sizes (e.g., length or width) and shapes than shown in FIGS. 1B, 1C.

The polymeric slidable lid 10 is formed in a generally or roughly rectangular shape. It is contemplated that the slidable lid may be of other shapes and sizes, but would typically correspond with the opening of the container 100.

Referring to FIGS. 2A-2F, the container 100 has at least one sidewall 102 and a flange 106. The at least one sidewall 102 in this embodiment is a generally rectangular shape that includes four sidewalls 102*b*-102*e*. The four sidewalls in this embodiment have rounded corners. It is contemplated that the at least one sidewall may be formed of other polygonal shapes or non-polygonal shapes.

The at least one sidewall 102 includes a child-resistant release tab 120 extending outwardly therefrom. As shown best in FIG. 2A, the child-resistant release tab 120 extends initially outwardly and then upwardly towards and adjacent to the flange 106. The child-resistant release tab 120 acts like a lever mechanism. The child-resistant release tab 120 includes a body portion 120*a* with extensions 120*b*, 120*c* extending therefrom that are adjacent to the flange 106. The child-resistant release tab 120 forms an opening or slot 122 between the extensions 120*b*, 120*c*. A top portion of the child-resistant release tab 120 is a U-shape.

Figure 4A:
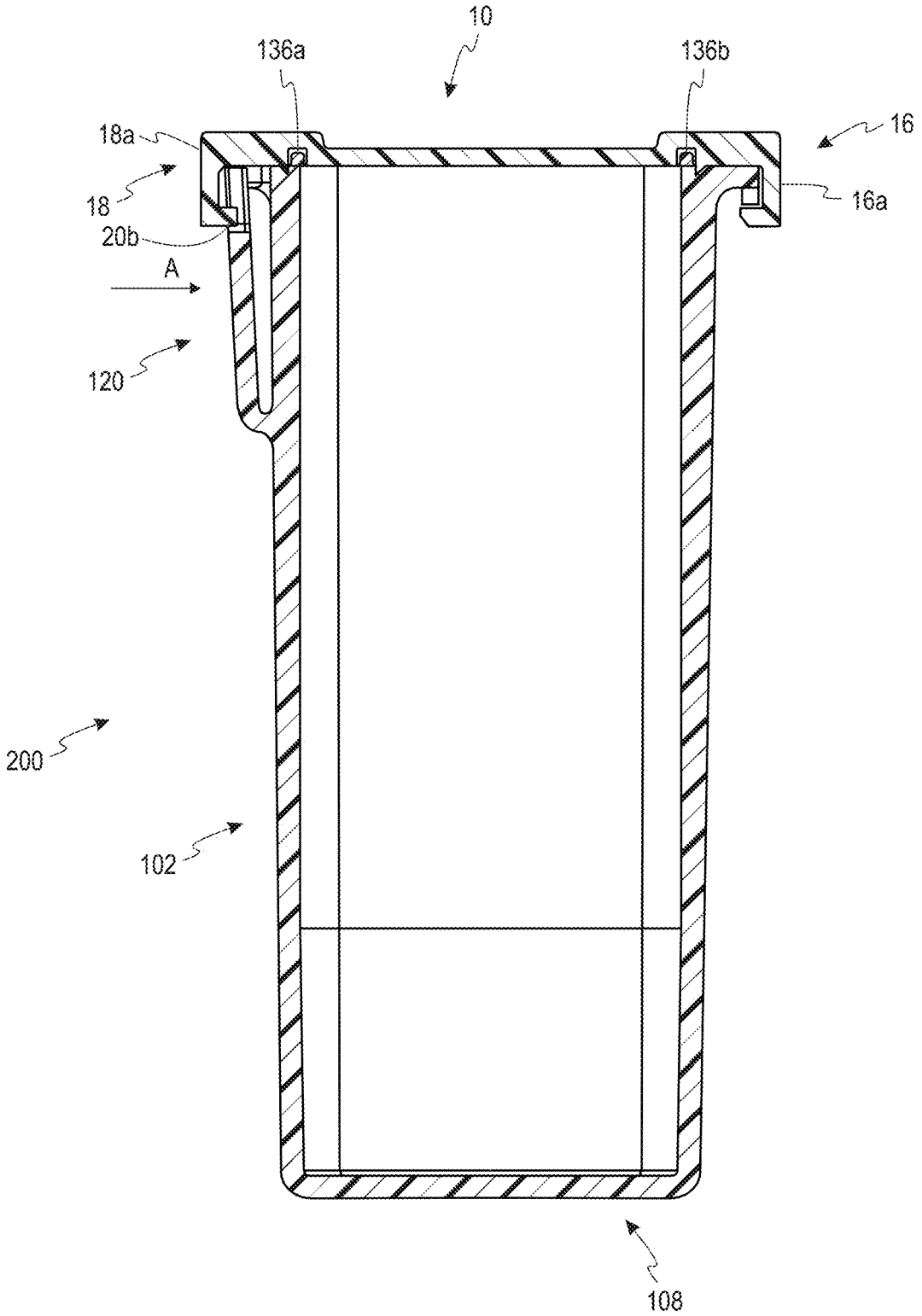
FIG. 4A is a cross-sectional view taken generally along line 4A-4A of the container assembly FIG. 3A in a closed position from the back of the container assembly.
Figure 4B:
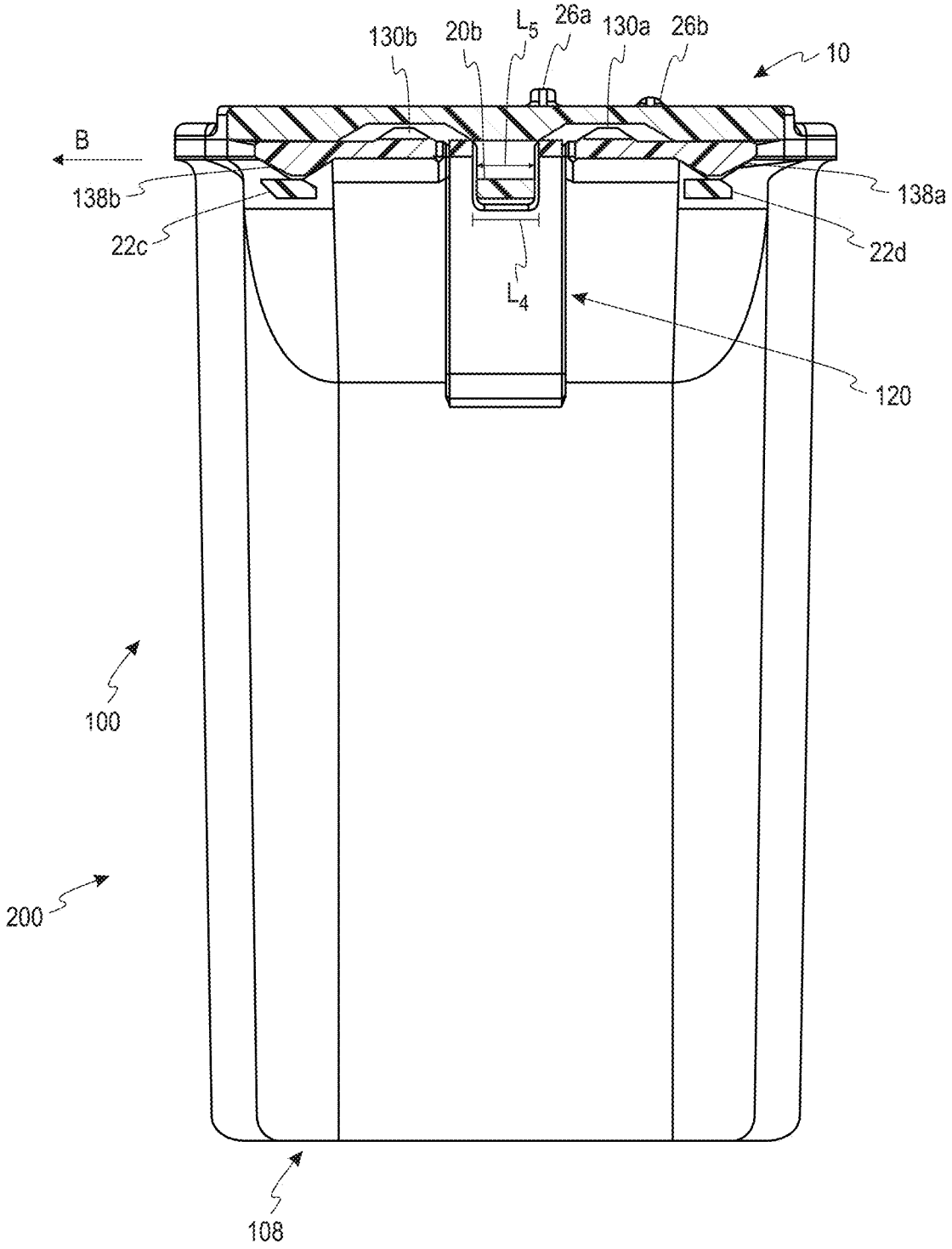
FIG. 4B is a cross-sectional view taken generally along line 4B-4B of the container assembly FIG. 3A in a closed position from the right side of the container assembly
Figure 4C:
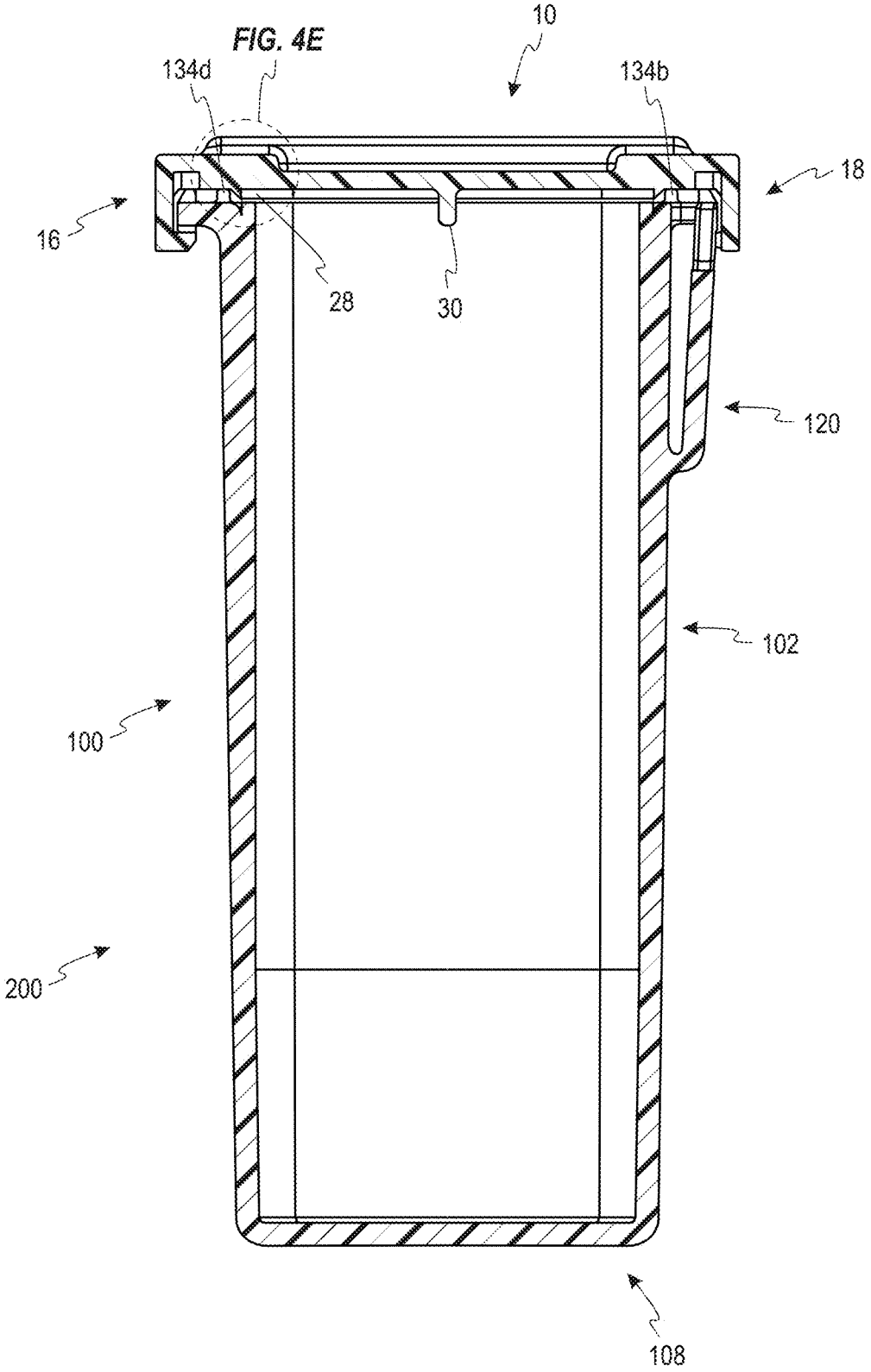
FIG. 4C is a cross-sectional view taken generally along and in an opposite direction of line 4A-4A of the container assembly FIG. 3A in an open position from the front of the container assembly.

The opening or slot 122 of the child-resistant release tab 120 is sized to receive the stop projection 20*b* of the polymeric slidable lid 10 (see FIG. 4B). As shown in FIG. 4B, a length L4 of the opening 120 is greater than a length L5 of the stop projection 20*b*. Similarly, a width W1 of the opening 120 (see FIG. 2A) is greater than a width of the stop projection 20*b*. The combination of the opening or slot 122 and the stop projection 20*b*, as will be discussed below, assists in preventing or inhibiting movement of the polymeric slidable lid 10. To move the polymeric slidable lid 10 with respect to the container 100, the child-resistant release tab 120 is configured to be depressed inwardly, resulting in the stop projection 20*b* no longer residing in the opening or slot 122.

In this embodiment, the child-resistant release tab 120 is integrally formed with the at least one sidewall 102. It is contemplated, however, that the child-resistant release tab may be formed separately and attached to the at least one sidewall.

The flange 106 encompasses and extends outwardly from the at least one sidewall 102 in this embodiment. The flange 106 is non-continuous in this embodiment. The flange 106 defines an opening 114 therein in which an interior space 116 of the container 100 is defined by the flange 106, the at least one sidewall 102, and a bottom 108. The flange 106 is located near a neck portion 104 of the container 102. The flange 106 forms a plurality of ramp or cam projections 130*a*-130*d* on a top surface 106*a* thereof. Each of the plurality of ramp projections 130*a*-130*d* is an elongated pyramid with a truncated, flat top portion or is of a trapezoidal shape. The plurality of ramp projections 130*a*-130*d* extends in a direction upwardly and away from the at least one sidewall 102 and the bottom 108. The ramp projections 130*a*, 130*b* are located directly adjacent to the extensions 120*b*, 120*c* of the child-resistant release tab 120.

Figure 2A:
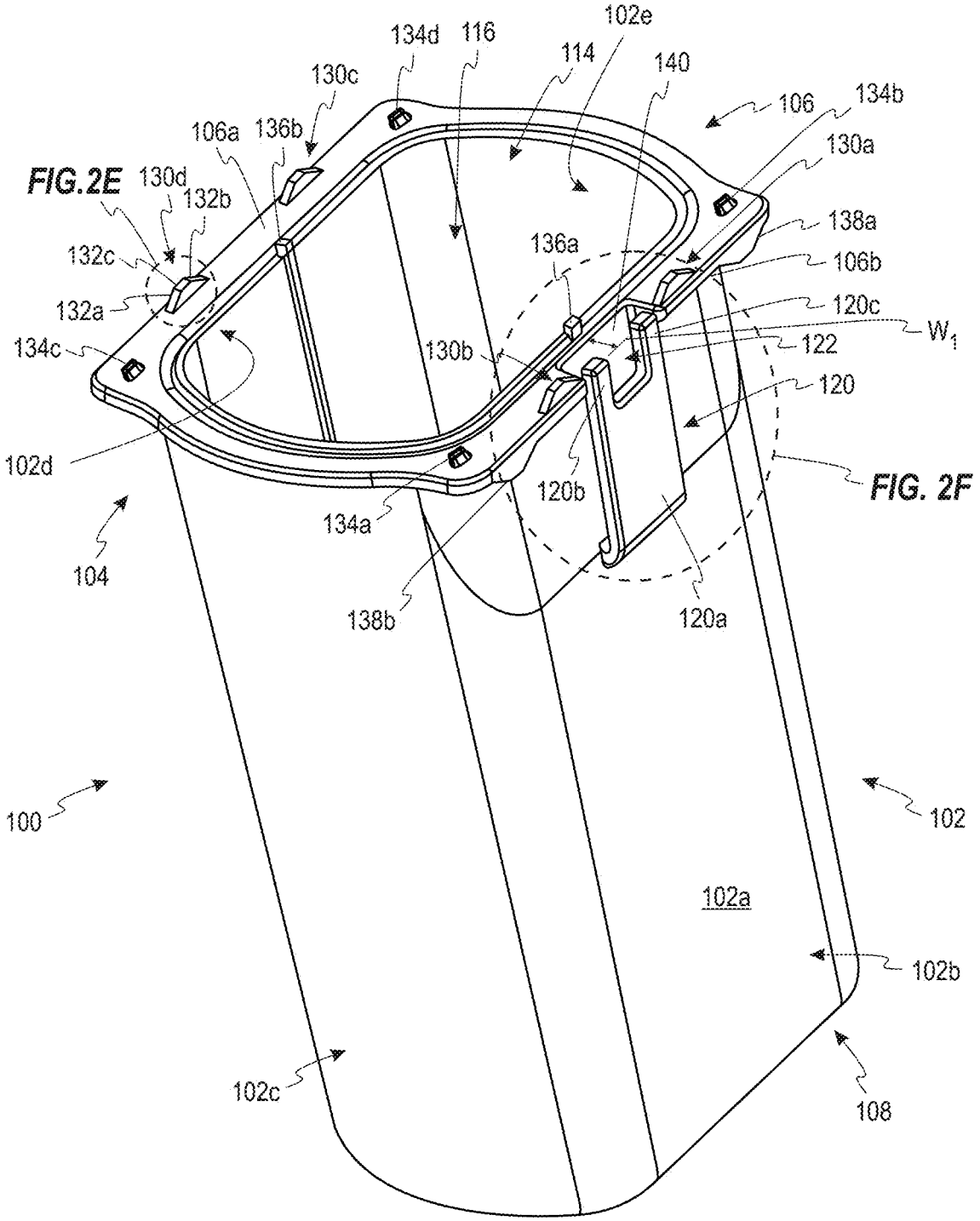
FIG. 2A is a top perspective view of a container according to one embodiment.
Figure 2B:
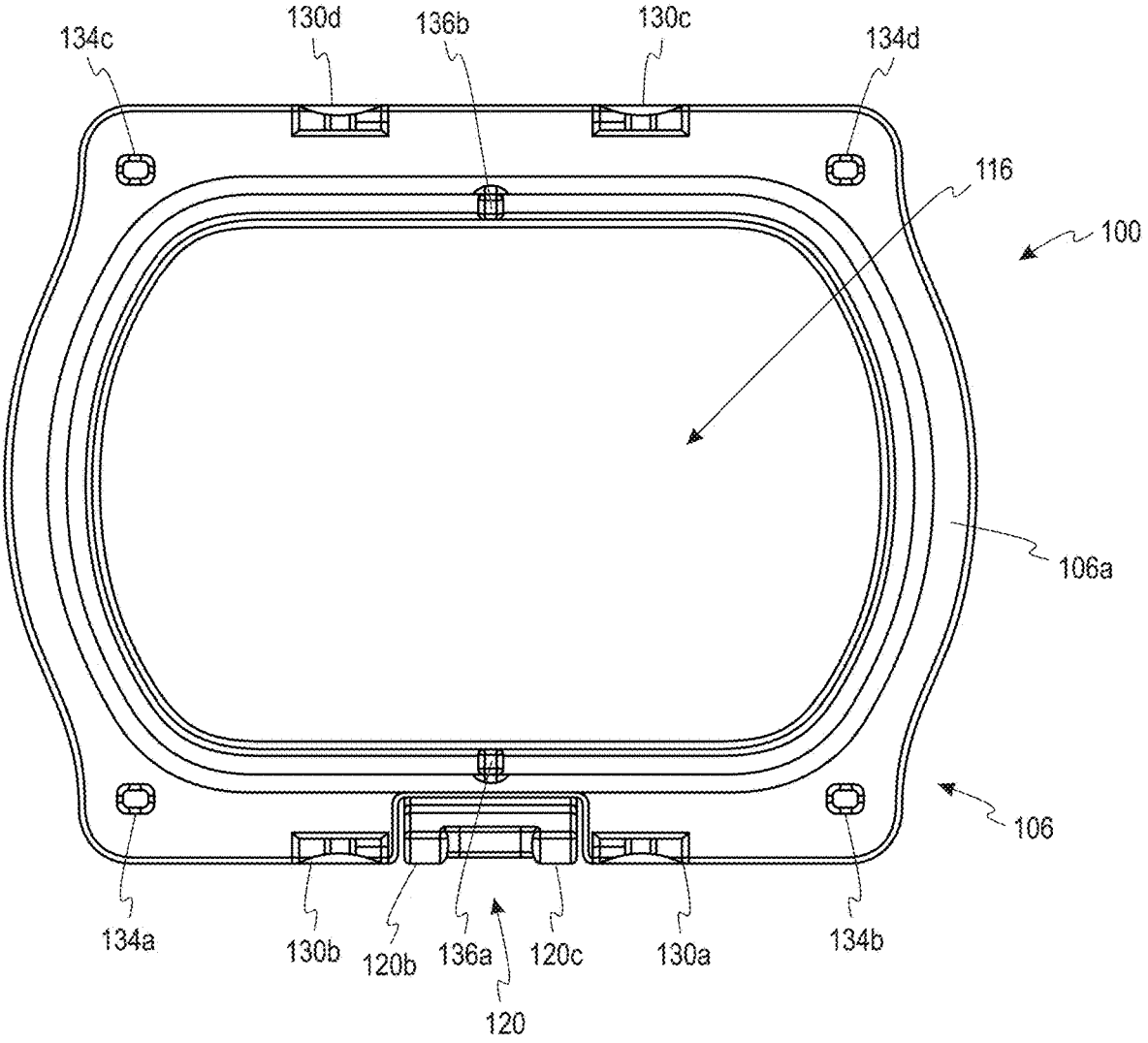
FIG. 2B is a top view of the container of FIG. 2A.
Figure 2C:
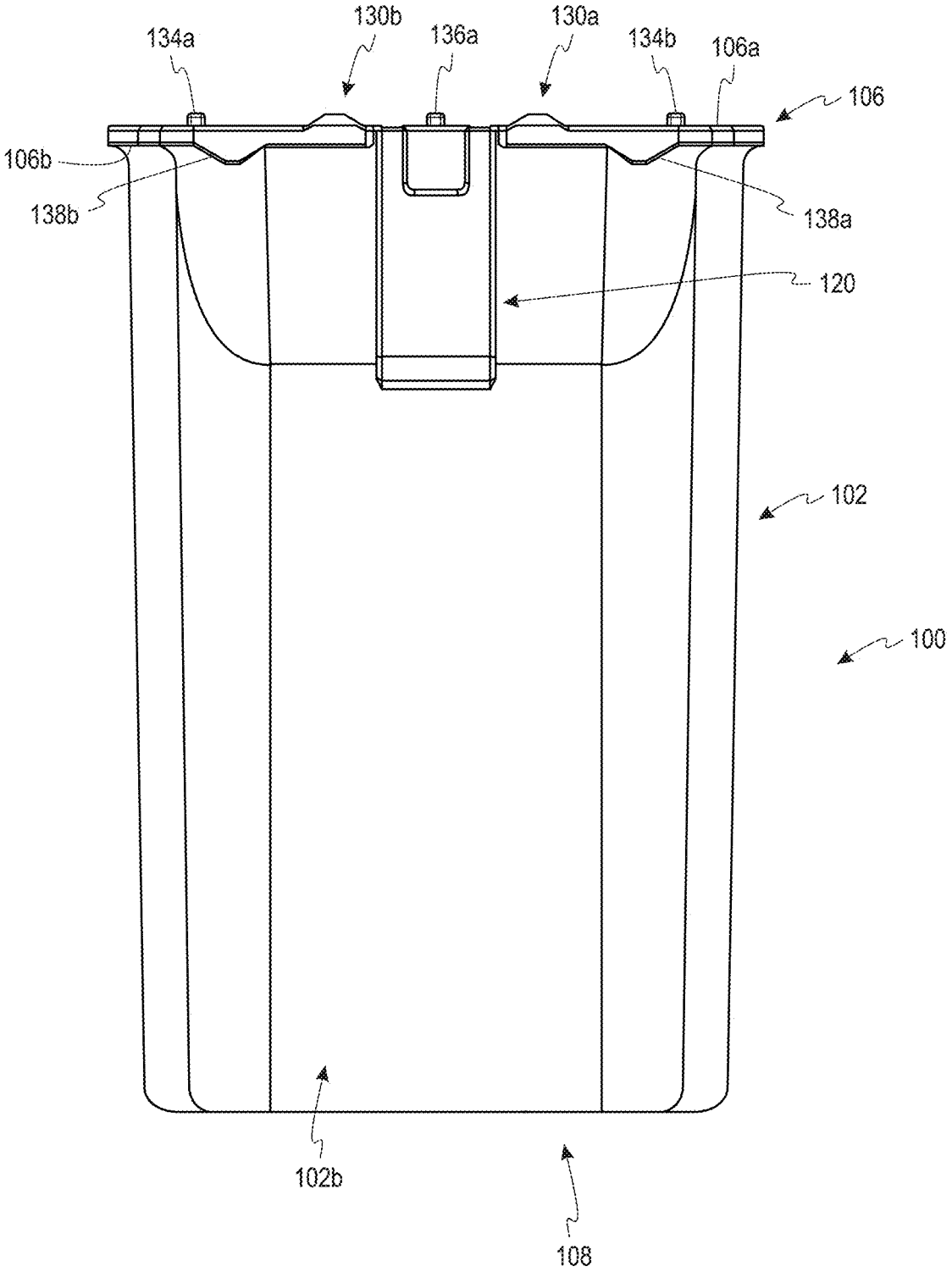
FIG. 2C is a right view of the container of FIG. 2A.
Figure 2D:
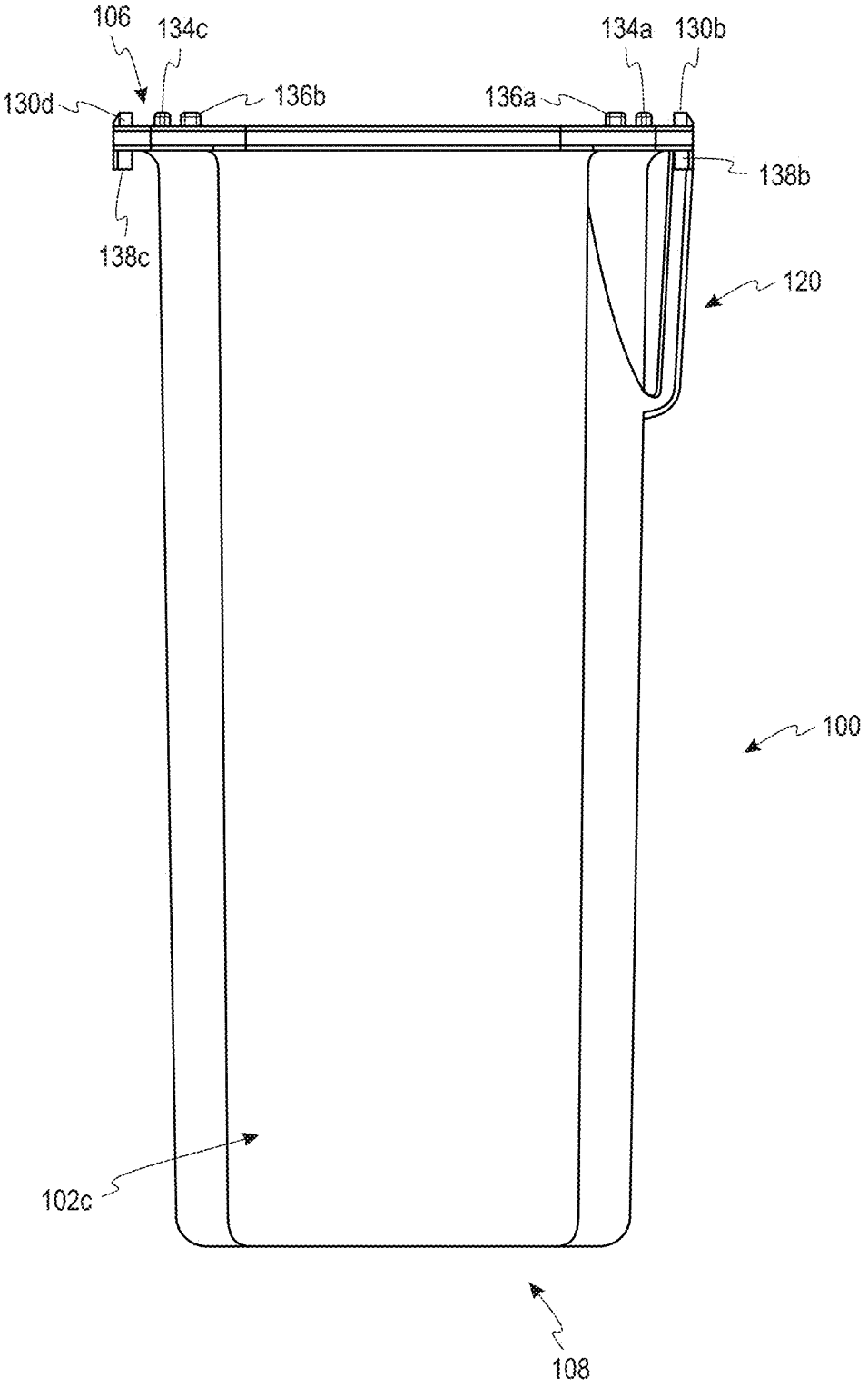
FIG. 2D is a front view of the container of FIG. 2A.
Figure 2E:
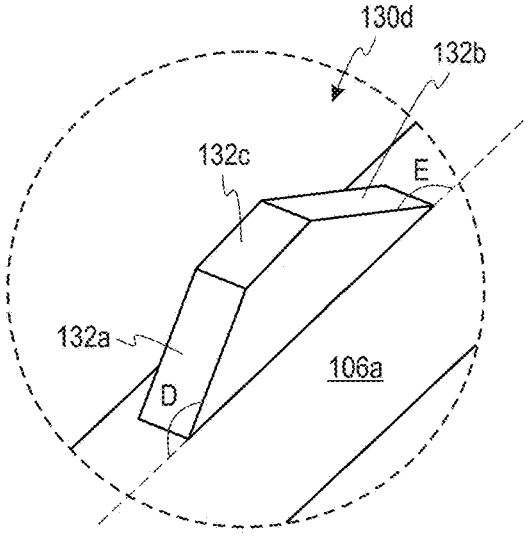
FIG. 2E is an enlarged top perspective view of circular region FIG. 2E in FIG. 2A.
Figure 2F:
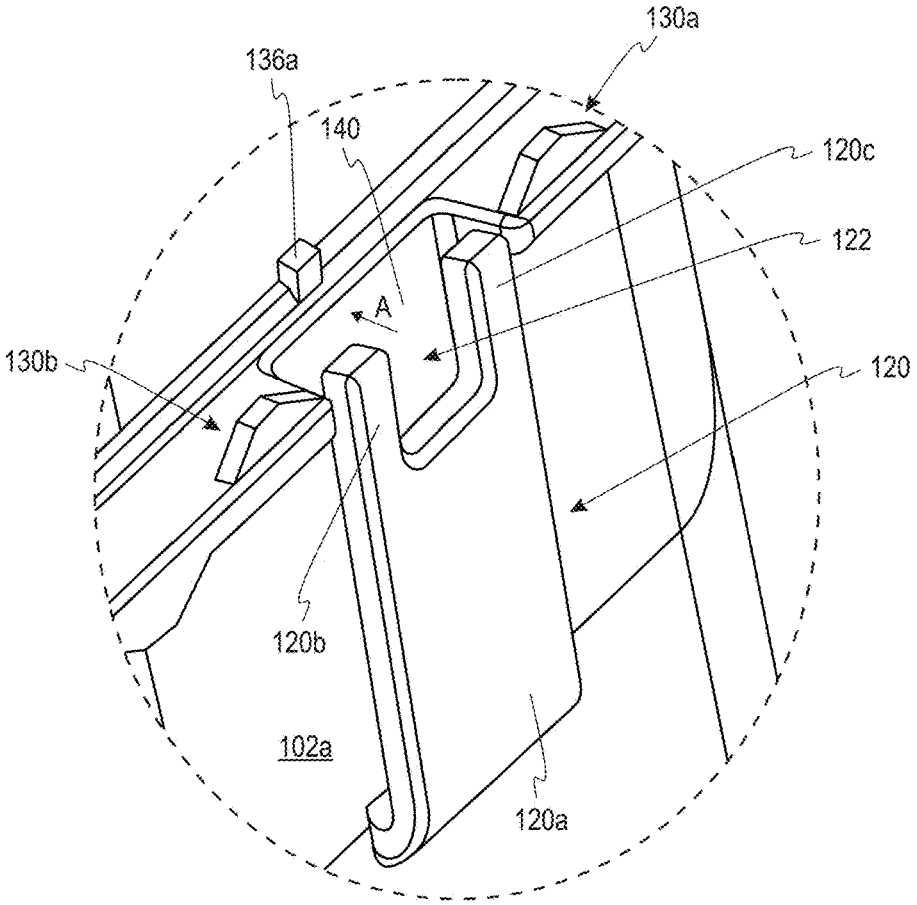
FIG. 2F is an enlarged top perspective view of circular region FIG. 2F in FIG. 2A.

Referring specifically to FIG. 2E, the ramp projection 130*d* is shown on the top surface 106*a* of the flange 106. The ramp projection 130*d* includes a plurality of angled portions 132*a*, 132*b* bridged by a flat top portion 132*c*. The angled portions 132*a*, 132*b* are typically from about 30 to about 60 degrees or, more specifically, from about 40 to about 50 degrees from the top surface 106*a* as measured by respective angles D, E.

The plurality of ramp projections 130*a*-130*d* assists in moving the polymeric slidable lid 10 to a different plane (i.e., at a different height and spaced from and above the flange 106). This higher plane is substantially parallel or parallel to the top surface 106*a* of the flange 106. By moving to a different and higher plane, this assists in protecting the sealing liner 28 from being destroyed or damaged by contact with the flange 106 during the sliding movement of the polymeric slidable lid 10. The ramp projections 130*a*-130*d* in raising to a higher parallel plane, release the sealing pressure on the sealing liner 28 before fully sliding open for use. Furthermore, by having the polymeric slidable lid 10 in a different plane also makes the polymeric slidable lid 10 easier to move once the generally linear movement has started as will be discussed in further detail below.

The plurality of ramp projections 130*a*-130*d* is shown in FIG. 2A as being identical. It is contemplated, however, that the ramp projections may be different from each other. The ramp projections, however, are desirably shaped and sized to enable the polymeric slidable lid to smoothly move to a different plane using the angled portions of the ramp projections.

To provide desired sealing in the linear sliding application, the flange 106 includes a plurality of inverted projections 138*a*-138*c* (see, e.g., FIGS. 2A, 2D) located on a bottom surface 106*b* thereof. The plurality of inverted projections 138*a*-138*c* (one of the inverted projections is not shown) is in each corner of the flange 106. Each of the inverted projections is shaped the same. In one embodiment, the inverted projected is an elongated pyramid with a truncated, flat top portion or is of a trapezoidal shape. It is contemplated, however, that the inverted projections may be shaped differently.

The inverted projections 138*a*-138*c* (and the one not shown) of the flange 106 correspond with a respective one of the undercut projections 22*a*-22*d*. The inverted projections of the flange 106 in combination the undercut projections 22*a*-22*d* assist in forcing down the polymeric slidable lid 10 to make a compressed seal between the sealing liner 28 and the container 100.

Referring back to FIG. 2A, the flange 106 forms a recessed opening 140 between the ramp projections 130*a*, 130*b*. This is also shown in an enlarged view in FIG. 2F. The recessed opening 140 is a generally rectangular shape. The recessed opening 140 is sized and shaped to receive the child-resistant release tab 120 therein by allowing movement of the child-resistant release tab 120 towards the exterior surface 102*a* of the at least one sidewall 102. This movement of the child-resistant release tab 120 is shown by arrow A in FIG. 2F. Before the polymeric slidable lid 10 can be moved, a user moves (typically pushes) the child-resistant release tab 120 in the direction of arrow A in FIG. 2F, which allows the stop projection 20*b* of the polymeric slidable lid 10 to clear the child-resistant release tab 120 and enable the polymeric slidable lid 10 to move to an open position as will be discussed below.

Referring back to FIG. 2A, the container 100 also includes a plurality of contacting nubs 134*a*-134*d* and a plurality of elongated nubs 136*a*, 136*b*. The plurality of contacting nubs 134*a*-134*d* is located in the general corners of the flange 106. The plurality of elongated nubs 136*a*, 136*b* is located in the general center of the flange 106. In this embodiment, the plurality of elongated nubs 136*a*, 136 extends from the bottom 108 of the container 100 to slightly above the flange 106. Each of the nubs 134*a*-134*d* extends upwardly from the flange 106.

With the container assembly in the closed position, the nubs 134*a*-134*d*, 136*a*, 136*b* are contained within one of the recesses 24*a*-24*f* of the polymeric slidable lid 10. Each of the nubs 134*a*-134*d*, 136*a*, 136*b* is a contact point for the polymeric slidable lid 10 when the polymeric slidable lid 10 is moved to a different plane. In the open position, the interior surface 12*b* of the polymeric slidable lid 10 rests initially on the nubs 134*a*-134*d*, 136*a*, 136*b* after the polymeric slidable lid 10 has moved up on the ramp projections 130*a*-130*d*. As the polymeric slidable lid 10 is continued to be moved linearly to enlarge the opening, in this embodiment, the number of contact points with the nubs will be reduced from 6 contact points to 4 contact points. The nubs 134*a*-134*d*, 136*a*, 136*b* assist in stabilizing the polymeric slidable lid 10 when in an open position.

It is contemplated that the number, the shape, and size of the nubs may vary from that shown in FIG. 2A. The height of the nubs should, however, be desirably identical to the height of the ramp projections.

Figure 3A:
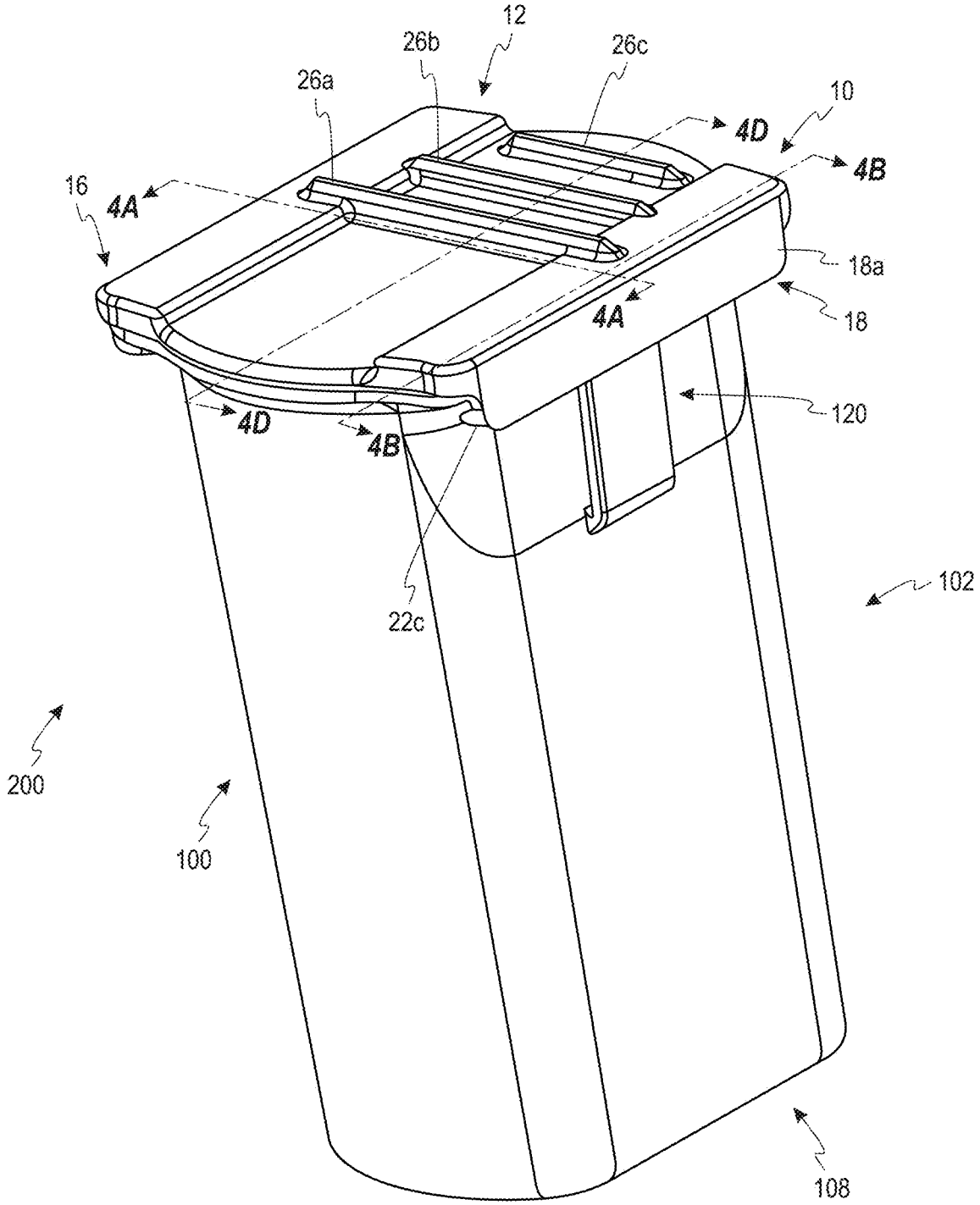
FIG. 3A is a top perspective view of a container assembly using the slidable lid of FIG. 1A and the container of FIG. 2A.
Figure 3B:
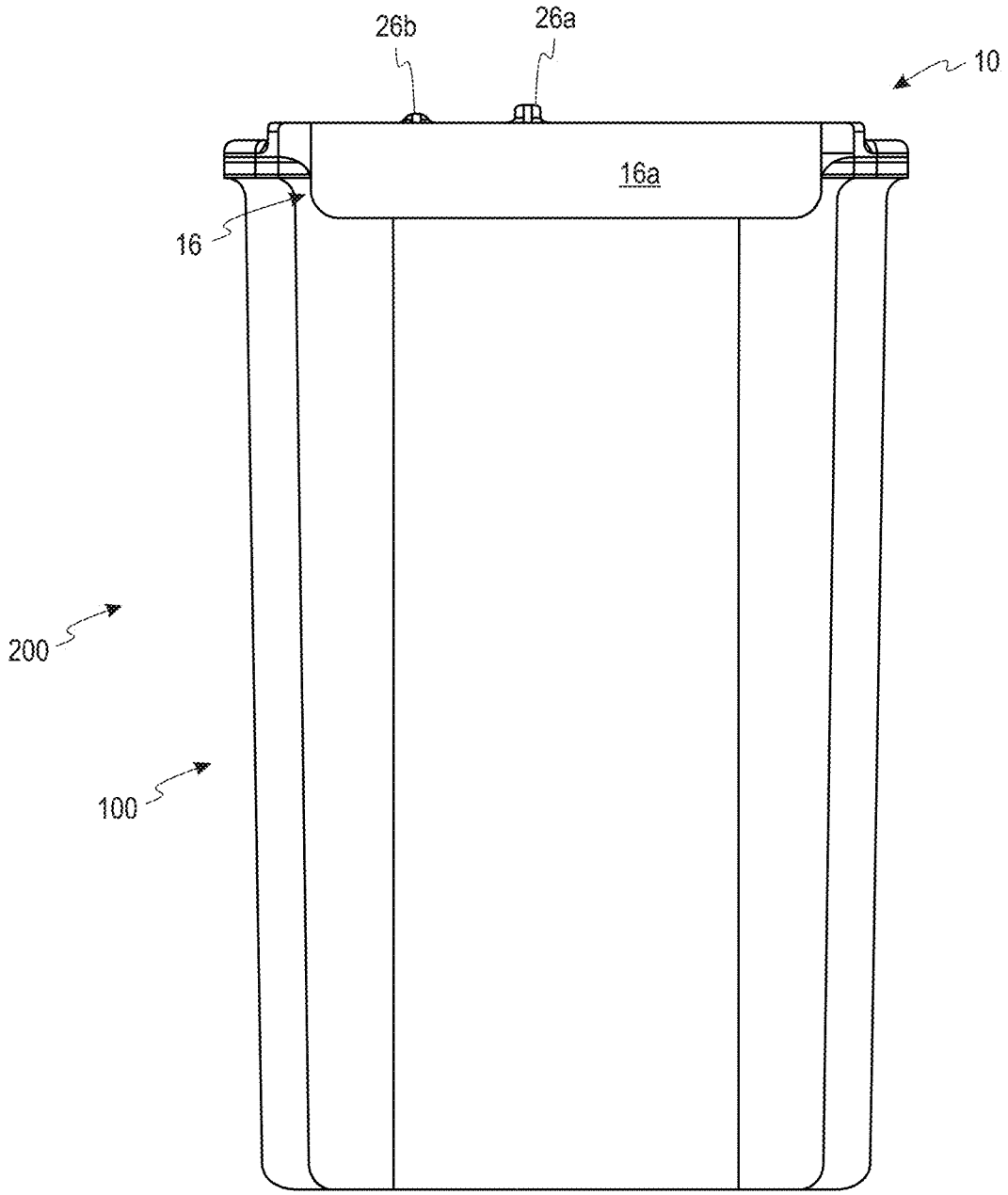
FIG. 3B is a left view of the container assembly of FIG. 3A.
Figure 3C:
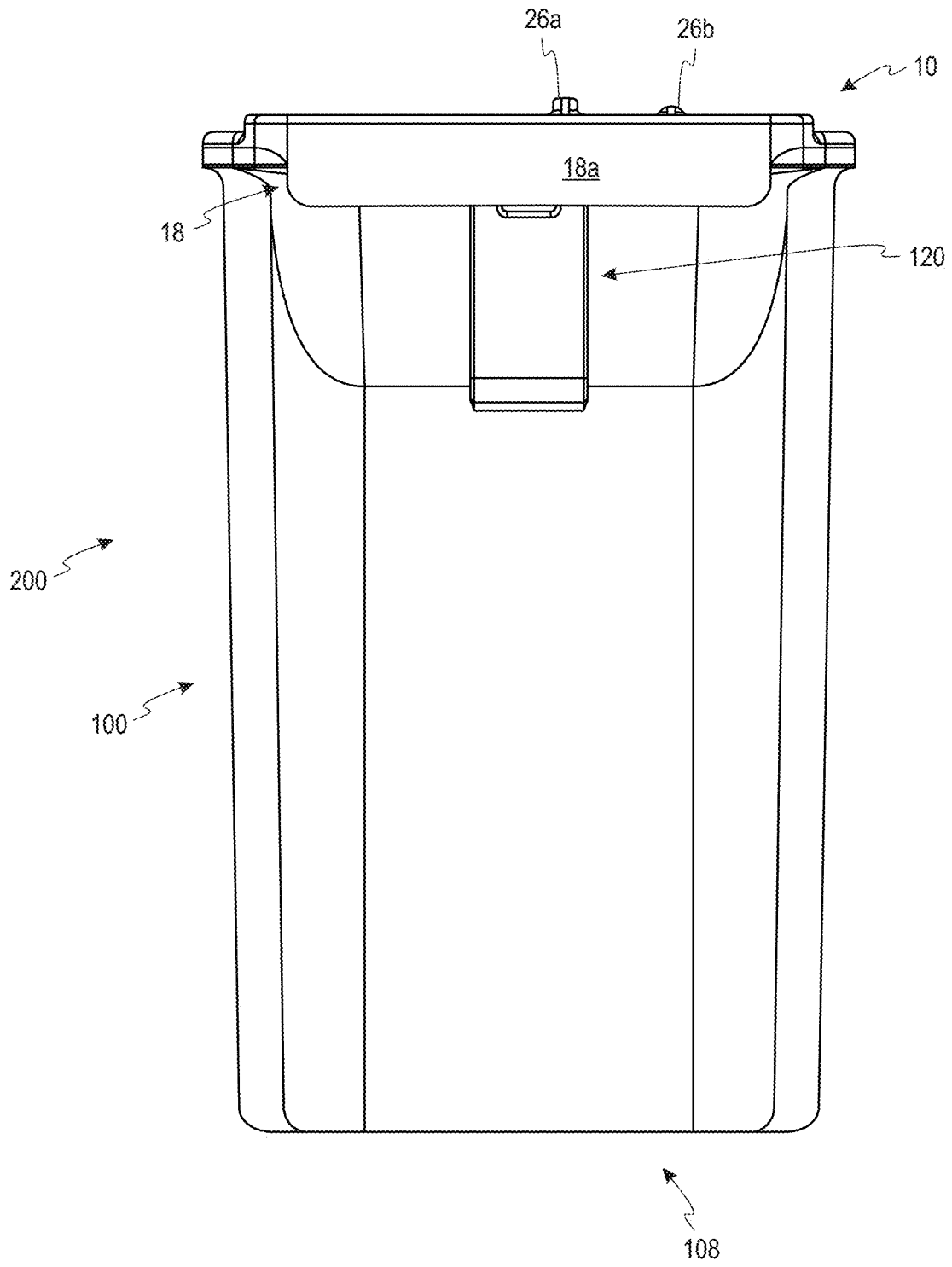
FIG. 3C is a right view of the container assembly of FIG. 3A.
Figure 3D:
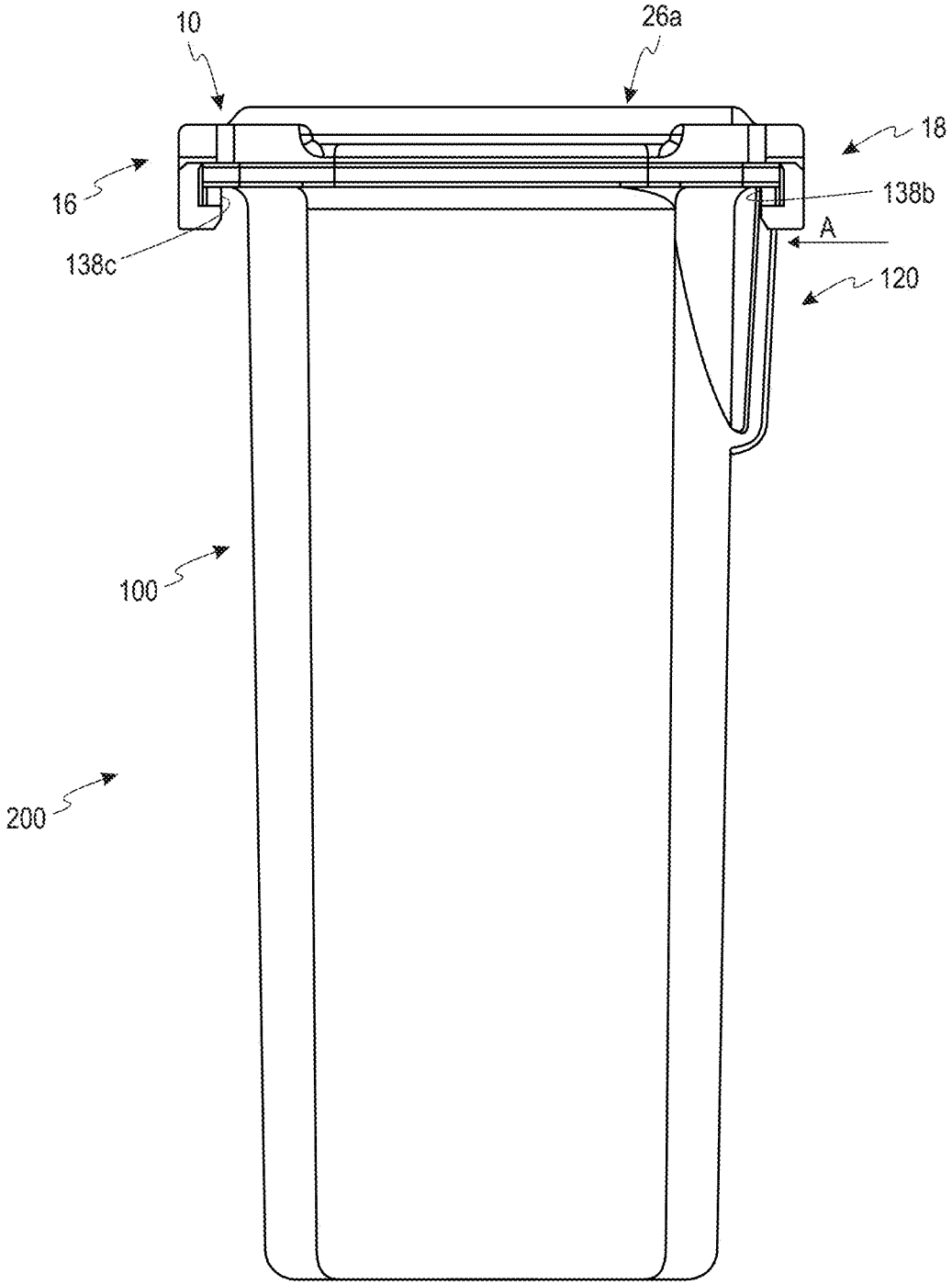
FIG. 3D is a front view of the container assembly of FIG. 3A.

The container assembly 200 includes the polymeric slidable lid 10 and the container 100 as shown in FIGS. 3A-3D. FIG. 3A is top perspective view of the container assembly 200. FIGS. 3B-3D are left, right and front views, respectively, of the container assembly 200. The polymeric slidable lid 10 is configured to slide into and along the flange 106 of the container 100 to open and close the container 100, which provides access to the contents of the container 100.

The polymeric slidable lid 10 is configured to be placed on the container 100 that contain product. In this embodiment, the polymeric slidable lid 10 is snapped or pressed onto the container 100. As discussed above, the opposing retention sidewalls 16, 18 flex outwardly when initially placed onto the flange 106 of the container 100. Once the polymeric slidable lid 10 is flexed outwardly during the placement onto the container 100, the polymeric slidable lid 10 snaps back onto the flange 106 of the container 100 and is held in place by the undercut projections 22*a*-22*d*.

The product may be a liquid product, but typically is a solid product. In another embodiment, the product may be a combination of a liquid and solid product. Some products that may be especially desirable to use include dispensable tablets such as over the counter (OTC) medication, vitamins, prescriptions, etc. It is noted that an opening formed by the maximum movement of the polymeric slidable lid 10 with respect to the container 100 may allow for metered dispersion of a product. The polymeric slidable lid may vary the opening size dependent upon product variation. The size of the opening could be varied by relocating and resizing the mechanical stop 30.

The container assembly may also include tamper-evident features. More specifically, the tamper-evident features show visual identification to a user that the polymeric slidable lid may have been moved to an open position and the product potentially been accessed. For example, the tamper-evident feature may be of a structure where the polymeric slidable lid 10 cannot be moved without removing or breaking the tamper-evident feature. Non-limiting examples include a tamper-evident feature located on a front and/or back of the container and on a top surface of the lid that assist in preventing or inhibiting the polymeric slidable lid 10 from sliding. This could be a break-away tab or a molded feature of the lid and/or container that needs to be broken or removed. It is contemplated that other tamper-evident features may be added to the container assembly.

The movement of the polymeric slidable lid 10 with respect to the container 100 is shown best in the various cross-sectional views of FIGS. 4A-4D. For a user to move the polymeric slidable lid 10 of the container assembly 200 from a closed position (FIGS. 4A, 4B) to an open position (FIGS. 4C, 4D) a user initially moves the child-resistant release tab 120 inwardly (in the direction of arrow A in FIG. 4A) and, thereafter, moves the polymeric slidable lid 10 linearly in the direction of arrow B (FIG. 4B). The direction of arrow A is in a generally transverse direction to the direction B. In other words, the direction of arrow A is generally perpendicular to the direction of arrow B.

Figure 4D:
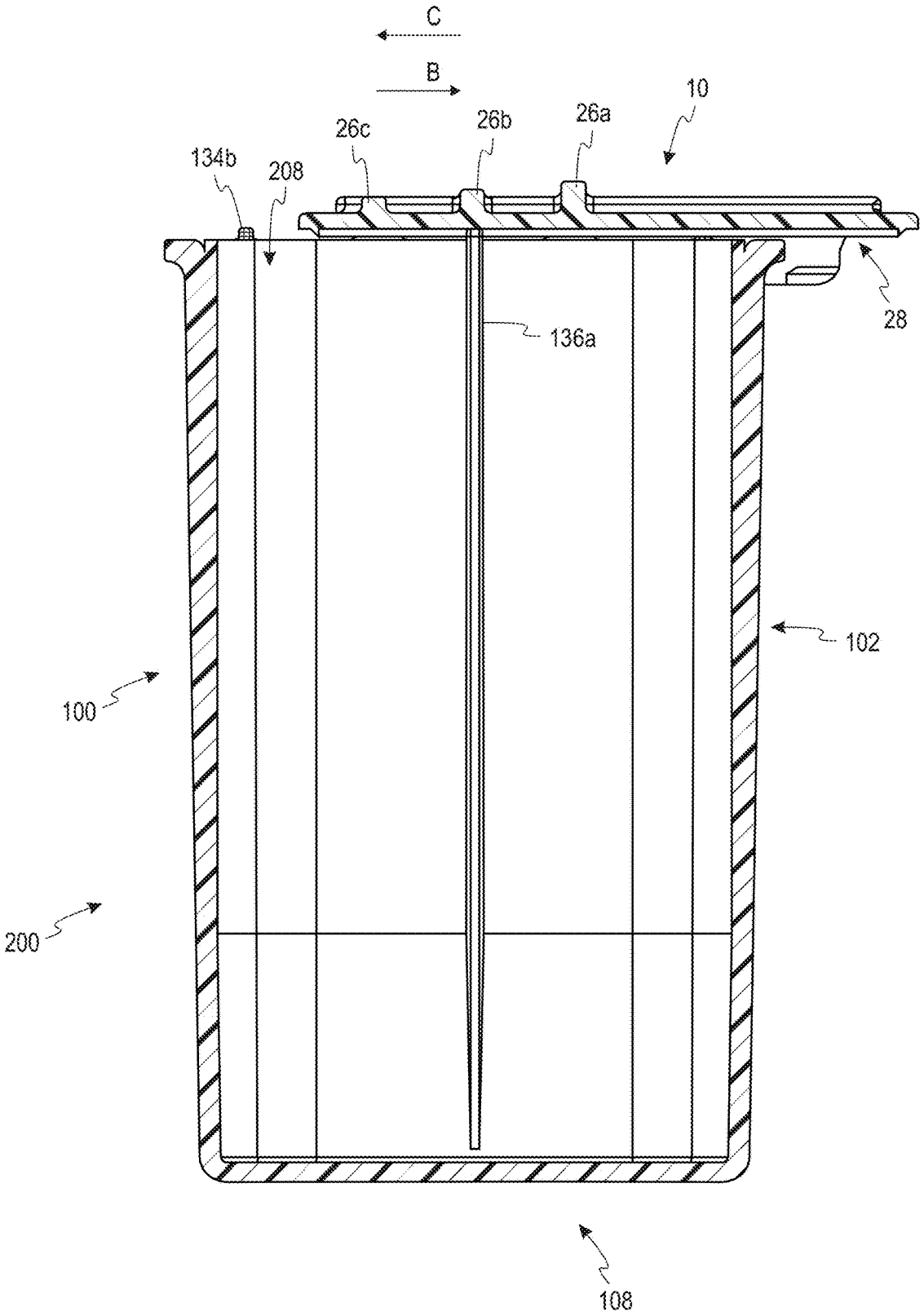
FIG. 4D is a cross-sectional taken generally along line 4D-4D of the container assembly FIG. 3A in an open position from the left side of the container assembly.

The movement of the child-resistant release tab 120 in the direction arrow A disengages the interference of the stop projection 20*b* of the polymeric slidable lid 10. Because of the child-resistant release tab 120 is angled outwardly, it is difficult to show the positioning in a cross-sectional view between the stop projection 20*b* and the child-resistant release tab 120 such as shown in FIG. 4D. After the initial movement of the polymeric slidable lid 10 with respect to the container 100, the child-resistant release tab 120 can be released. The initial movement of the child-resistant release tab 120 inwardly (in the direction of arrow A in FIG. 4A) is performed by pushing in one embodiment. It is contemplated that the initial movement of the child-resistant release tab 120 inwardly (in the direction of arrow A in FIG. 4A) may be performed by pulling.

Figure 4E:
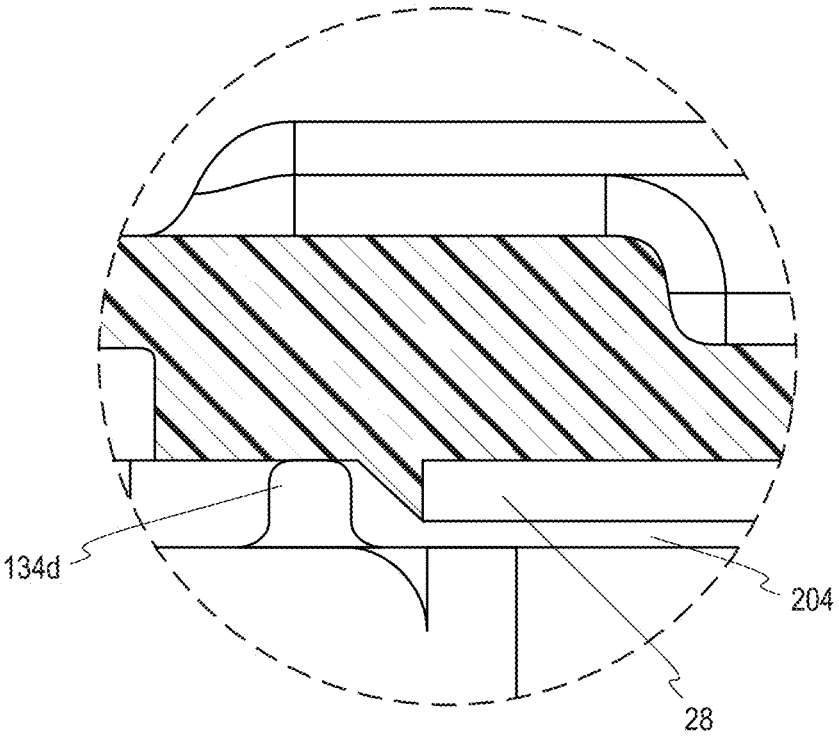
FIG. 4E is an enlarged cross-sectional view of circular region 4E in FIG. 4C.

Once the polymeric slidable lid 10 is moved in the direction of the arrow B, the undercut projections 22*a*-22*d* begin disengaging with a respective one of the inverted projections 138*a*-138*c* (another one not shown) to release the pressure on the sealing liner 28. As the movement continues in the direction of arrow B, each of the ramp projections 130*a*-130*d* contacts the interior surface 12*b* of the polymeric slidable lid 10 and raises the polymeric slidable lid 10 to a higher plane parallel to the top surface 106*a* of the container 100. The movement of the polymeric slidable lid 10 proceeds upwardly on the plurality of angled portions of the ramp projections until reaching the flat top portion 132*c* of the ramp projection. At this point, the container assembly 200 is in a fully open position in which a gap 204 is formed between the polymeric slidable lid 10 and the container 100 as best shown in FIG. 4E. The width of the gap 204 between the polymeric slidable lid 10 and the container 100 is generally from about 0.02 to about 0.06 inches or, more specifically, from about 0.03 to about 0.05 inches. Thus, the polymeric slidable lid 10 is in a different and higher plane in the open position than in the closed position.

When the container assembly 200 is in an open position, the polymeric slidable lid 10 contacts a number of contacting nubs 134*a*-134*d* and a plurality of elongated nubs 136*a*, 136*b*. One of these contacting nubs (elongated nub 134*b*) is shown in FIG. 4D. FIG. 4D also shows an opening 208 formed at the movement of the polymeric slidable lid 10 with respect to the container 100. This plane is parallel to a top portion 106*a* of the flange 106 of the container 100. As the polymeric slidable lid 10 continues to move in the direction of arrow B, the opening 208 will continue to enlarge.

To close the opening 208 formed at the movement of the polymeric slidable lid 10 with respect to the container 100, a user moves the polymeric slidable lid 10 in the direction of arrow C. The user will continue to move the polymeric slidable lid 10 until the plurality of undercut projections re-engage a respective one of the inverted projections 138*a*-138*c* (another one not shown) to reassert the pressure on the sealing liner 28.

In one method, these operations are performed by the finger or thumb of one hand. It is contemplated that the opening process may be performed by two hands.

The polymeric slidable lid is typically made of polymeric material, such as olefins (e.g., polyethylene (PE), polypropylene (PP)) or blends thereof. One example of a polyethylene that may be used is high density polyethylene (HDPE). It is contemplated that the polymeric slidable lid may be made of other polymeric materials.

The slidable lids are typically formed by processes such as injection or compression molding.

It is also contemplated that the slidable lid may be made of non-polymeric materials such as metal.

The container 100 is typically made of polymeric material. One non-limiting example of a material to be used in forming a polymeric container is polyethylene terephthalate (PET), polypropylene (PP) or blends using the same. It is contemplated that the container may be formed of other polymeric or copolymer materials. The container 100 is typically have an encapsulated oxygen-barrier layer or oxygen barrier material incorporated therein. In another embodiment, the container may be made of non-polymeric materials such as metal.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above-described embodiment, method, and examples, but by all embodiments and methods within the scope and spirit of the invention.

What is claimed is:

1. A container assembly comprising:

a container having at least one sidewall, a bottom and a flange, the at least one sidewall including a child-resistant release tab extending outwardly therefrom and being configured for movement towards the at least one sidewall, the child-resistant release tab forming a first opening or slot therein, the flange and the at least one sidewall assisting in forming a second opening defining an interior of the container, the flange including a top surface and an interior surface, the flange including a plurality of ramp projections extending upwardly from the top surface thereof; and a polymeric slidable lid being configured for fitment to the container for closing the second opening, the polymeric slidable lid including an exterior surface and an interior surface, the polymeric slidable lid including a polymeric top portion and two opposing retention sidewalls, the polymeric top portion bridging and encompassing the two opposing retention sidewalls, at least one of the two opposing retention sidewalls including a sidewall portion and a stop projection extending inwardly from the sidewall portion, the interior surface of the polymeric slidable lid including a sealing liner, wherein the stop projection and the child-resistant release tab assist in preventing or inhibiting movement of the container assembly from a closed position to an open position, wherein after the child-resistant release tab is moved towards the at least one sidewall, the polymeric slidable lid is configured to slide from the closed position to the open position, and wherein the polymeric slidable lid is configured to contact the plurality of ramp projections resulting in further movement of the polymeric slidable lid into a different axial plane spaced above the flange of the container.

2. The container assembly of claim 1, wherein the flange is an outwardly extending flange.

3. The container assembly of claim 1, wherein the flange is non-continuous.

4. The container assembly of claim 1, wherein the flange forms a plurality of nubs on the top surface thereof, the plurality of nubs assisting in stabilizing the polymeric slidable lid in the open position.

5. The container assembly of claim 4, wherein the plurality of nubs are located in corners and in a middle portion of the top surface of the flange.

6. The container assembly of claim 1, wherein each of the plurality of ramp projections is an elongated pyramid with a truncated, flat top portion or is of a trapezoidal shape.

7. The container assembly of claim 1, wherein two of the plurality of ramp projections are directly adjacent to the child-resistant release tab.

8. The container assembly of claim 1, wherein the at least one sidewall is a plurality of sidewalls, the plurality of sidewalls is of a rectangular shape.

9. The container assembly of claim 1, wherein the child-resistant release tab is integrally formed with the at least one sidewall.

10. The container assembly of claim 1, wherein the interior surface of the flange includes a plurality of inverted projections, each of the opposing retention sidewalls includes a plurality of undercut projections that assist in preventing or inhibiting the polymeric slidable lid from being removed axially from the container, the plurality of inverted projections and the plurality of undercut projections assisting in providing a compressed seal between the sealing liner and the container.

11. The container assembly of claim 1, wherein the polymeric top portion has an exterior surface and an interior surface, the exterior surface of the polymeric top portion including a plurality of ridges to assist a user in sliding the polymeric slidable lid to expose the second opening of the container.

12. The container assembly of claim 1, wherein each of the two opposing retention sidewalls includes one respective stop projection extending inwardly from one respective sidewall portion.

13. The container assembly of claim 1, wherein each of the two opposing retention sidewalls includes a plurality of undercut projections that assist in preventing or inhibiting the polymeric slidable lid from being removed axially from the container.

14. The container assembly of claim 1, wherein the interior surface of the polymeric slidable lid includes a mechanical stop to assist in preventing or inhibiting the polymeric slidable lid from being removed from the container during movement of the polymeric slidable lid.

15. A container assembly comprising:

a container having at least one sidewall, a bottom and an outwardly extending flange, the flange and the at least one sidewall assisting in forming an opening defining an interior of the container, the flange including a top surface and an interior surface, the flange including a plurality of ramp projections extending upwardly from the top surface thereof, the flange including a plurality of inverted projections extending downwardly from the interior surface thereof; and a polymeric slidable lid being configured for fitment to the container for closing the opening, the polymeric slidable lid including an exterior surface and an interior surface, the polymeric slidable lid including a polymeric top portion and two opposing retention sidewalls, the polymeric top portion bridging and encompassing the two opposing retention sidewalls, at least one of the two opposing retention sidewalls including a sidewall portion, the interior surface of the polymeric slidable lid including a sealing liner, each of the two opposing retention sidewalls further forming a plurality of undercut projections that assist in preventing or inhibiting the polymeric slidable lid from being removed axially from the container, the plurality of inverted projections and the plurality of undercut projections assisting in providing a compressed seal between the sealing liner and the container, wherein the polymeric slidable lid is configured to slide from a closed position to an open position, and wherein the polymeric slidable lid is configured to contact the plurality of ramp projections resulting in further movement of the polymeric slidable lid into a different axial plane spaced above the outwardly extending flange of the container as the polymeric slidable lid is moved to the open position.

16. The container assembly of claim 15, wherein the sidewall portion includes a child-resistant release tab extending outwardly therefrom and being configured for movement towards the at least one sidewall, the child-resistant release tab forming a first opening or slot therein, and wherein the polymeric slidable lid further includes a stop projection extending inwardly from the sidewall portion, and wherein the stop projection and the child-resistant release tab assist in preventing or inhibiting movement of the container assembly from the closed position to the open position.

17. The container assembly of claim 15, wherein the outwardly extending flange forms a plurality of nubs on the top surface thereof, the plurality of nubs assisting in stabilizing the polymeric slidable lid in the open position.

18. The container assembly of claim 15, wherein each of the plurality of ramp projections is an elongated pyramid with a truncated, flat top portion or is of a trapezoidal shape.

19. The container assembly of claim 15, wherein the interior surface of the polymeric slidable lid includes a mechanical stop to assist in preventing or inhibiting the polymeric slidable lid from being removed from the container during movement of the polymeric slidable lid from the closed position to the open position.

* * * * *